US005706793A

United States Patent [19]

Orzel et al.

[11] Patent Number: 5,706,793

[45] Date of Patent: Jan. 13, 1998

[54] METHOD AND SYSTEM FOR MONITORING FUEL DELIVERY OF AN ENGINE

[75] Inventors: Daniel V. Orzel, Westland; David Karl Bidner, Livonia, both of Mich.

[73] Assignee: Ford Global Technologies, Inc., Dearborn, Mich.

[21] Appl. No.: 786,131

[22] Filed: Jan. 17, 1997

[51] Int. Cl.[6] ..... F02D 41/00

[52] U.S. Cl. ..... 123/690

[58] Field of Search ..... 123/690, 481, 123/198 F, 673; 364/431.11, 424.03, 431.01, 431.04, 431.05, 431.12

[56] References Cited

U.S. PATENT DOCUMENTS

| | | | |
|---|---|---|---|
| 5,226,267 | 7/1993 | Sogawa | 364/431.11 |
| 5,331,560 | 7/1994 | Tamura | 364/431.12 |
| 5,408,974 | 4/1995 | Lipinski et al. | 123/481 |
| 5,579,747 | 12/1996 | Sato et al. | 123/690 |
| 5,611,319 | 3/1997 | Machida | 123/690 |
| 5,623,913 | 4/1997 | Kitajima et al. | 123/673 |

*Primary Examiner*—Raymond A. Nelli
*Attorney, Agent, or Firm*—Allan J. Lippa; Roger L. May

[57] ABSTRACT

A method and system for monitoring fuel delivery to an internal combustion engine having a first and second mode of operation and controlling the engine accordingly. An oxygen content of exhaust gas emitted from the engine is sensed and a corresponding oxygen content signal is generated. Air fuel ratio correction data is determined based on the oxygen content signal. If the engine is operating in the first mode, the air fuel ratio correction data is compared to a first set of predetermined air fuel ratio correction thresholds and a first failure signal is generated based on the comparison between the air fuel ratio correction data and the first set of predetermined air fuel ratio correction thresholds. If the engine is operating in the second mode, the air fuel ratio correction data is compared to a second set of predetermined air fuel ratio correction thresholds and a second failure signal is generated based on the comparison between the air fuel ratio correction data and the second set of predetermined air fuel ratio correction thresholds. The engine is controlled based on the first and second failure signals.

19 Claims, 3 Drawing Sheets

*Fig. 2b*

METHOD AND SYSTEM FOR MONITORING FUEL DELIVERY OF AN ENGINE

TECHNICAL FIELD

This invention relates to methods and systems for monitoring a fuel delivery system of an engine having at least two modes of operation.

BACKGROUND ART

A fuel delivery system must comply with On-Board Diagnostics-II (OBD-II) emission standards set by the California Air Resources Board (CARB) and the Environmental Protection Agency (EPA). The CARB requires an automobile manufacturer to monitor the fuel delivery system for its ability to provide compliance with emission standards. Thus, the fuel delivery monitoring system must indicate a malfunction by activating a Malfunction Indicator Light (MIL) and by setting OBD-II codes when the fuel delivery system can no longer compensate for changes in the fuel system components, including rich and lean compensations.

It becomes challenging to monitor the fuel delivery system when the engine has at least two cylinder modes of operation. For example, a Variable Displacement Engine (VIDE) is an engine that operates on all cylinders when a heavy load is being demanded, such as during an acceleration. However, during a light load condition, such as a part-throttle cruise, some of the engine's cylinders are disabled by rendering the intake and exhaust valve rocker arms of these cylinders inoperative, thereby keeping the valves closed. Also, the fuel injectors of the disabled cylinders are turned off. The benefit of a VDE is that it is more fuel efficient when operating in the four cylinder mode. Since different fueling errors can occur when the engine is one mode of operation versus the other, monitoring of the fuel delivery system is different for each mode of operation.

DISCLOSURE OF THE INVENTION

It is thus a general object of the present invention to provide a method and system for monitoring a fuel delivery system of an engine having a first and second mode of operation.

In carrying out the above object and other objects, features, and advantages of the present invention, a method is provided for monitoring fuel delivery strategy to an internal combustion engine having a first and second mode of operation and controlling the engine accordingly. The method includes sensing an oxygen content of the exhaust gas emitted from the engine and generating a corresponding oxygen content signal. The method also includes the step of determining air fuel ratio correction data based on the oxygen content signal. If the engine is operating in the first mode, the air fuel ratio correction data is compared to a first set of predetermined air fuel ratio correction thresholds to obtain a first signal. If the engine is operating in the second mode, the air fuel ratio correction data is compared to a second set of predetermined air fuel ratio correction thresholds to obtain a second signal. The engine is controlled based on the first and second signals.

In further carrying out the above object and other objects, features, and advantages of the present invention, a system is also provided for carrying out the steps of the above described method.

Still further in carrying out the above object and other objects, features, and advantages of the present invention, an article of manufacture is provided. The article of manufacture includes a computer storage medium having a computer program encoded therein for causing a computer to control the engine. The computer program determines air fuel correction data based on the oxygen content signal, compares the air fuel ratio correction data to a first set of predetermined air fuel ratio correction thresholds to obtain a first signal, compares the air fuel ratio correction data to a second set of predetermined air fuel ratio correction thresholds to obtain a second signal, and controls the engine based on the first and second signals.

The above object and other objects, features and advantages of the present invention are readily apparent from the following detailed description of the best mode for carrying out the invention when taken in connection with the accompanying drawings.

BEST MODES FOR CARRYING OUT THE INVENTION

Figure 1:
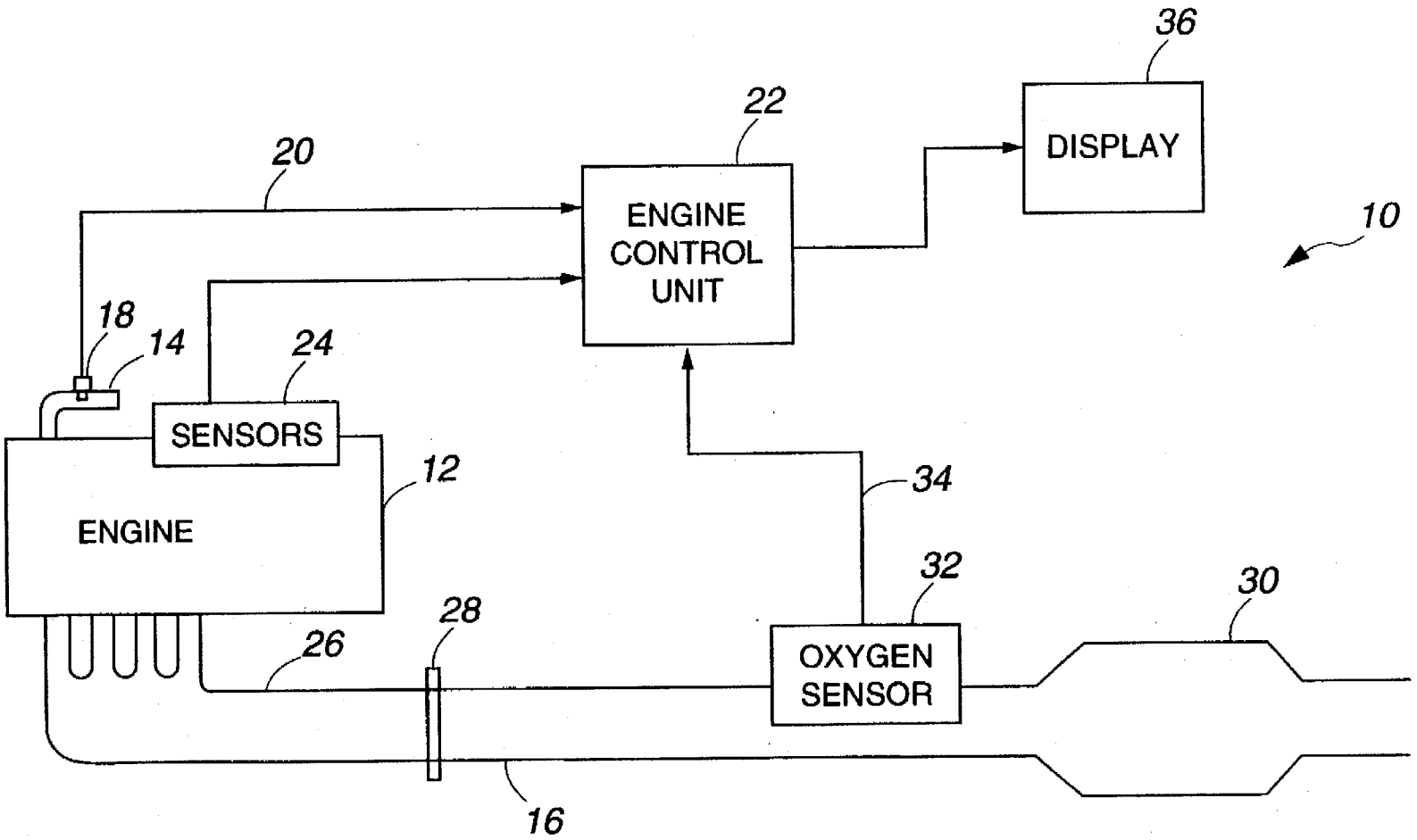
FIG. 1 is a schematic diagram of a vehicle engine and an electronic engine controller which embody the principles of the invention; and FIGS. *2a–2b* is a flowchart illustrating the general sequence of steps associated with the operation of the present invention.

Turning now to FIG. 1, there is shown a schematic diagram of the fuel monitoring system of the present invention, denoted generally by reference numeral 10. The fuel monitoring system 10 includes an internal combustion engine 12 having an intake manifold 14 and an exhaust system 16. Positioned in the intake manifold 14 is a conventional mass air flow sensor 18 for detecting the amount of air inducted into the engine 12 and generating a corresponding air flow signal 20 for receipt by an Engine Control Unit (ECU) 22. The air flow signal 20 is utilized by the ECU 22 to calculate a value termed air mass (AM) which is indicative of a mass of air flowing into the engine 12.

The system 10 further includes other sensors, indicated generally at 24, for providing additional information about engine performance to the ECU 22, such as crankshaft position, angular velocity, throttle position, air temperature, engine coolant temperature, etc. The information from these sensors is used by the ECU 22 to control operation of the engine 12, including the amount of fuel to be delivered to the engine 12.

The exhaust system 16, comprising an exhaust manifold 26 and an exhaust flange 28, transports exhaust gas produced from combustion of an air/fuel mixture in the engine 12 to a catalytic converter 30. An upstream oxygen sensor 32, such as a heated exhaust gas oxygen (HEGO) sensor, positioned upstream of the catalytic converter 30 on the exhaust system 16 of the engine 12, detects the oxygen content of the exhaust gas generated by the engine 12 and transmits a representative signal 34 to the ECU 22. The oxygen sensor 32 provides a signal having a high state when air/fuel ratio operation is on the rich side of a predetermined air/fuel ratio commonly referred to as stoichiometry (14.7 lbs. air/lb. fuel in this example). When the engine air/fuel operation is lean of stoichiometry, the oxygen sensor 32 provides its output signal at a low state. The signal 34 is then used by the ECU 22 in controlling the amount of fuel delivered to the engine 12.

In determining the amount of fuel that needs to be delivered to the engine 12, a short term air fuel ratio correction factor, LAMBSE, is typically utilized to adjust the fuel delivery to compensate for rich or lean fueling errors as detected by the oxygen sensor 32. LAMBSE is typically an integral of the output signal 34 from the oxygen sensor 32, and is at an average value of unity when the engine 12 is operating at stoichiometry and there are no steady-state air/fuel errors or offsets. For a typical example of operation, LAMBSE ranges from 0.75–1.25.

A long term air fuel ratio adaptive correction factor, KAMRF, is also utilized that stores fuel calculation correction values in a table based on engine speed and load, or air charge temperature. These correction values are utilized in adjusting fuel delivery to the engine 12 as follows:

$$\text{Fuel flow}=\text{Air Mass}\times\text{KAMRF}/14.65\times\text{LAMBSE}.$$

An adaptive fuel control strategy reduces the effects of product variability and compensates for slowly drifting (rich or lean) fuel delivery hardware such as the mass airflow sensor 14, fuel injectors (not shown), fuel pressure regulator (not shown), etc. When the fuel control strategy drifts rich or lean from its nominal, the adaptive fuel table, KAMRF, compensates for this change. If the change continues, the adaptive fuel control reaches a clip limit, after which no further long term compensation can occur. At this point, LAMBSE moves towards its clip limit, after which no more short term correction can occur, resulting in a loss of fuel control.

Fuel monitoring is designed to meet the CARB's OBD-II requirements by monitoring the proper function of fuel delivery. The fuel monitoring system 10 will activate a display 36, such as a Malfunction Indicator Light (MIL), and set codes in the ECU 22 when the fuel control strategy can no longer compensate for changes in the fuel system components. This applies to both rich and lean compensations. The inability to compensate for fuel delivery errors is determined by either LAMBSE or KAMRF being at, or near, their clip limits.

The fuel monitoring system 10 of the present invention may be used with an engine having at least two cylinder modes of operation, a four cylinder and an eight cylinder mode of operation, such as a Variable Displacement Engine (VDE). Since different fueling errors can occur when the VDE is one mode of operation vs. the other, separate four and eight cylinder adaptive KAMRF tables and LAMBSEs are used. Because there are two separate KAMRF tables and LAMBSEs (one for four cylinder and one for eight cylinder operation), there needs to be two separate fuel system monitors, i.e., a four cylinder monitor and an eight cylinder monitor.

Figure 2A:
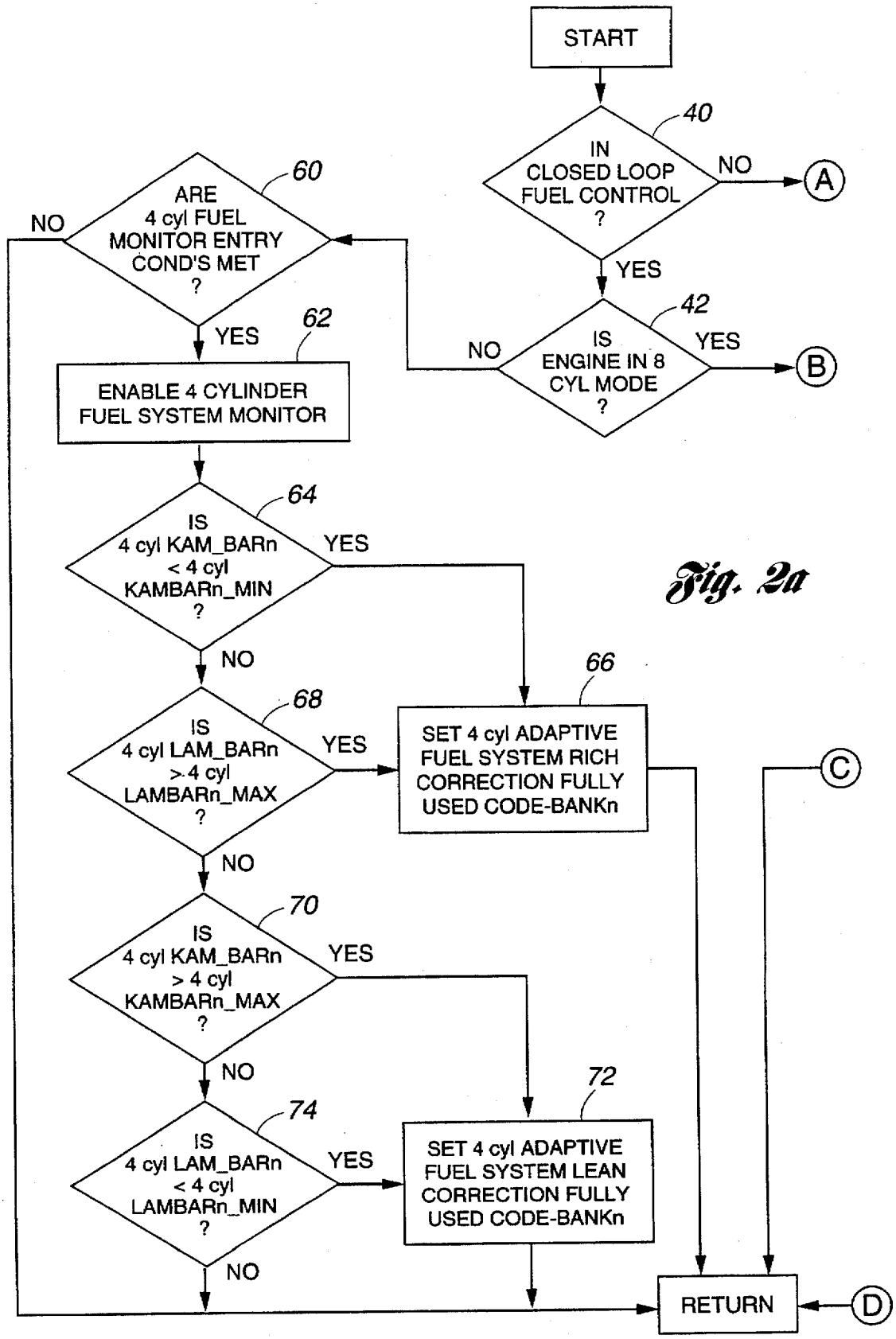
Figure 2B:
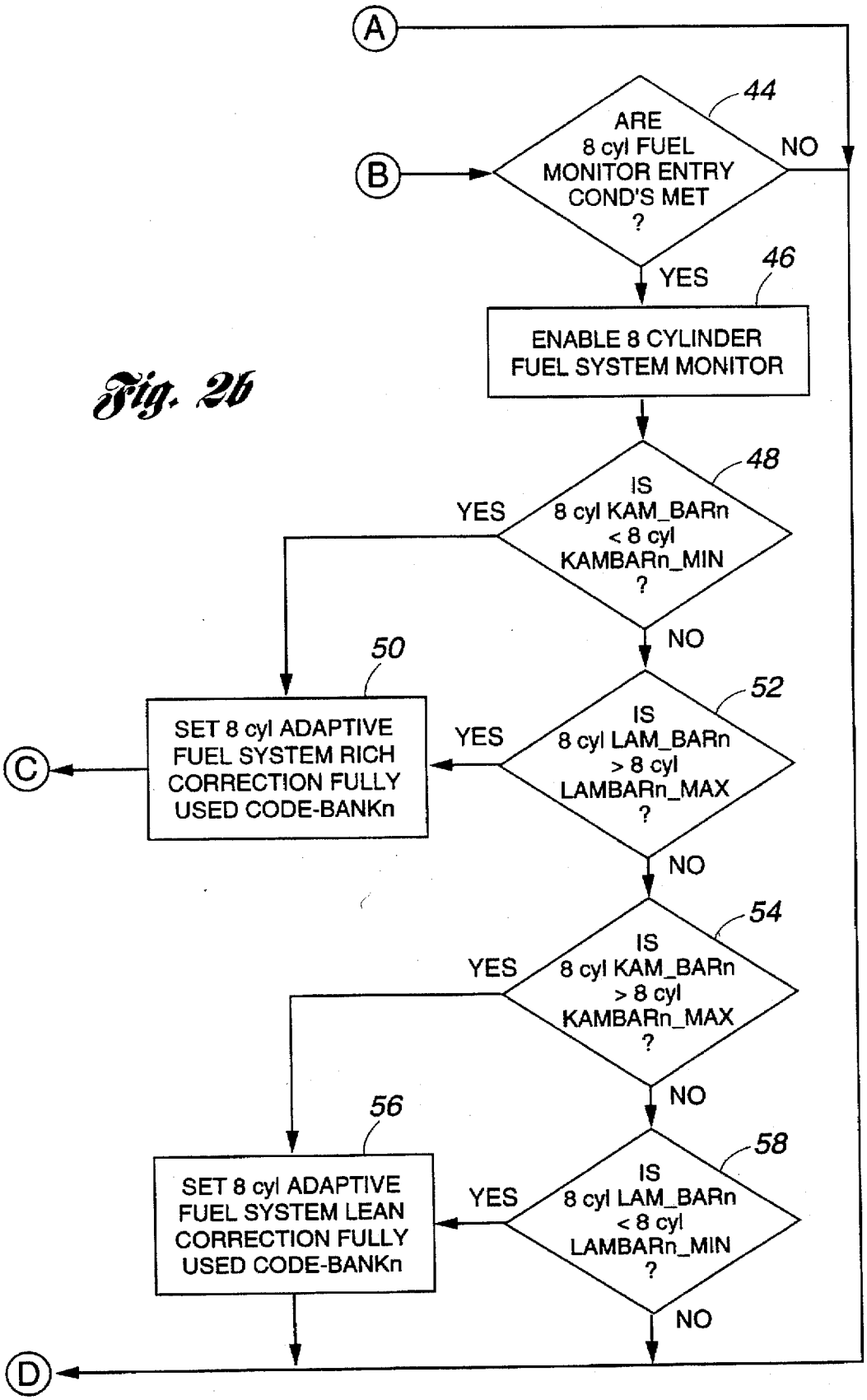

FIG. 2 is a flowchart showing the steps in a routine performed by a control logic, or the ECU 22. The ECU 22 may be comprised of hardware, software or a combination thereof, such as a memory device having a computer program stored therein. Although the steps shown in FIG. 2 are depicted sequentially, they can be implemented utilizing interrupt-driven programming strategies, object oriented programming, or the like. In a preferred embodiment, the steps shown in FIG. 2 comprise a portion of a larger routine which performs other engine control functions. FIG. 2 shows the steps in a fuel system monitoring routine performed by the ECU 22 to monitor the fuel control during one of two cylinder modes of operation during engine operation.

Before entering the monitoring system of the present invention, a check is made as to whether or not closed loop fuel control is in progress, as shown at conditional block 40. If not, the fuel monitor system of the present invention is not initiated. If so, a determination is made as to what cylinder mode of operation the engine 12 is operating in, as shown at conditional block 42. This determination is made based on the status of a predetermined flag, NCYL, which indicates which cylinder mode of operation the engine is operating in. The cylinder mode of operation is selected based on a plurality of engine parameters. One known method for selecting a particular cylinder mode of operation is disclosed in U.S. Pat. No. 5,408,974, issued to Lipinski et al., which is hereby incorporated in its entirety.

If the engine 12 is operating in an eight cylinder mode, a plurality of entry conditions must be met prior to entering the eight cylinder fuel system monitor, as shown at conditional block 44. Predetermined entry conditions must be met, such as a predetermined engine coolant temperature, minimum and maximum engine speed and air charge temperature, etc. If the predetermined entry conditions are met, the eight cylinder fuel system monitor is enabled, as shown at block 46.

First, an air fuel ratio correction variable, KAM_BARn, representing the long term air fuel ratio correction factor determined upon sensing the oxygen content of the exhaust gas, is compared to a predetermined 8 cylinder minimum long term air fuel ratio correction threshold, 8 cyl KAMBARn_MIN, as shown at conditional block 48. If the long term air fuel ratio correction variable KAM_BARn is less than the 8 cylinder minimum long term air fuel ratio correction threshold, a failure signal is generated, as shown at block 50. If the long term air fuel ratio correction variable is less than the predetermined 8 cylinder minimum long term air fuel ratio correction threshold, the adaptive fuel control system rich correction variable has reached its trim limit.

If the long term air fuel ratio correction variable KAM_BARn is not less than the 8 cylinder minimum long term air fuel ratio correction threshold, a short term air fuel ratio correction variable, LAM_BARn, is compared to a predetermined 8 cylinder maximum short term air fuel ratio correction threshold, 8 cyl LAMBARn_MAX, as shown at conditional block 52. If the short term air fuel ratio correction variable is greater than the 8 cylinder maximum short term air fuel ratio correction threshold, a failure signal is generated, as shown at block 50. Again, if the short term air fuel ratio correction variable is greater than the predetermined 8 cylinder maximum short term air fuel ratio correction threshold, the adaptive fuel control system rich correction variable has reached its trim limit.

If the short term air fuel ratio correction variable is not greater than the 8 cylinder maximum short term air fuel ratio correction threshold, the long term air fuel ratio correction variable, KAM_BARn, is compared to a predetermined 8 cylinder maximum long term air fuel ratio correction threshold, 8 cyl KAMBARn_MAX, as shown at conditional block 54. If the long term air fuel ratio correction variable is greater than 8 cyl KAMBARn_MAX, a failure signal is generated, as shown at block 56. If the long term air fuel ratio correction variable is greater than 8 cyl KAMBARn_MAX, then the adaptive fuel control system lean correction variable has reached its trim limit.

If the long term fuel correction variable is not greater than 8 cyl KAMBARn_MAX, then the short term air fuel ratio correction variable is compared to a predetermined 8 cylinder minimum short term air fuel ratio correction threshold, 8 cyl LAMBARn_MIN, as shown at conditional block 58. If the short term air fuel ratio correction variable is less than 8 cyl KAMBARn_MIN, then a failure signal is generated, as shown at block 56. If not, a failure signal is not generated.

Returning to conditional block 42, if the engine is not operating in an 8 cylinder mode, the engine is then operating in the 4 cylinder mode, and the fuel system monitor performs in a similar manner as in the 8 cylinder mode. First, a plurality of entry conditions must be met prior to entering the 4 cylinder fuel system monitor, as shown at conditional block 60. Predetermined entry conditions must be met, such as a predetermined engine coolant temperature, minimum and maximum engine speed and air charge temperature, etc. If the predetermined entry conditions are met, the 4 cylinder fuel system monitor is enabled, as shown at block 62.

The long term air fuel ratio correction variable, KAM_BARn, is compared to a predetermined 4 cylinder minimum long term air fuel ratio correction threshold, 4 cyl KAMBARn_MIN, as shown at conditional block 64. If the long term air fuel ratio correction variable KAM_BARn is less than the 4 cylinder minimum long term air fuel ratio correction threshold, a failure signal is generated, as shown at block 66. If the long term air fuel ratio correction variable is less than the predetermined 4 cylinder minimum long term air fuel ratio correction threshold, the adaptive fuel control system rich correction variable has reached its trim limit.

If the long term air fuel ratio correction variable KAM_BARn is not less than the 4 cylinder minimum long term air fuel ratio correction threshold, a short term air, fuel ratio correction variable, LAM_BARn, is compared to a predetermined 4 cylinder maximum short term air fuel ratio correction threshold, 4 cyl LAMBARn_MAX, as shown at conditional block. If the short term air fuel ratio correction variable is greater than the 4 cylinder maximum short term air fuel ratio correction threshold, the failure signal is generated, as shown at block 66.

If the short term air fuel ratio correction variable is not greater than the 4 cylinder maximum short term air fuel ratio correction threshold, the long term air fuel ratio correction variable, KAM_BARn, is compared to a predetermined 4 cylinder maximum long term air fuel ratio correction threshold, 4 cyl KAMBARn_MAX, as shown at conditional block 70. If the long term air fuel ratio correction variable is greater than 4 cyl KAMBARn_MAX, a failure signal is generated, as shown at block 72. If the long term air fuel ratio correction variable is greater than 4 cyl KAMBARn_MAX, then the adaptive fuel control system lean correction variable has reached its trim limit.

If the long term air fuel ratio correction variable is not greater than 4 cyl KAMBARn_MAX, then the short term air fuel ratio correction variable is compared to a predetermined 4 cylinder minimum short term air fuel ratio correction threshold, 4 cyl LAMBARn_MIN, as shown at conditional block 74. If the short term air fuel ratio correction variable is less than 4 cyl LAMBARn_MIN, then the failure signal is generated, as shown at block 72. If not, a failure signal is not generated.

Thus, the fuel monitoring system 10 of the present invention, includes two cylinder monitor systems, one for each cylinder mode of operation. The present invention allows different pass/fail thresholds to be calibrated based on the cylinder operating mode of the engine 12 in case one threshold has a different impact on emissions than the other.

While the best modes for carrying out the invention have been described in detail, those familiar with the art to which this invention relates will recognize various alternative designs and embodiments for practicing the invention as defined by the following claims.

What is claimed is:

1. A method for monitoring fuel delivery to an internal combustion engine and controlling the engine accordingly, the engine having a first and second mode of operation and emitting exhaust gas, the method comprising:

sensing an oxygen content of the exhaust gas and generating an oxygen content signal;

determining air fuel ratio correction data based on the oxygen content signal;

if the engine is operating in the first mode, comparing the air fuel ratio correction data to a first set of predetermined air fuel ratio correction thresholds to obtain a first signal;

if the engine is operating in the second mode, comparing the air fuel ratio correction data to a second set of predetermined air fuel ratio correction thresholds to obtain a second signal; and controlling the engine based on the first and second signals.

2. The method as recited in claim 1 wherein controlling the engine based on the first signal includes generating a first failure signal based on the comparison between the air fuel ratio correction data and the first set of predetermined air fuel ratio correction thresholds.

3. The method as recited in claim 2 wherein controlling the engine based on the second signal includes generating a second failure signal based on the comparison between the air fuel ratio correction data and the second set of predetermined air fuel ratio correction thresholds.

4. The method as recited in claim 3 further comprising illuminating a display in response to the first or second failure signal.

5. The method as recited in claim 1 further comprising determining if the engine is operating in the first mode or the second mode.

6. The method as recited in claim 5 wherein determining if the engine is operating in the first mode or the second mode includes determining a number of cylinders activated during operation of the engine.

7. The method as recited in claim 1 wherein determining air fuel ratio correction data includes determining a long term air fuel ratio factor and determining a short term air fuel ratio factor.

8. The method as recited in claim 7 wherein comparing the air fuel ratio correction data to the first set of predetermined air fuel ratio correction thresholds comprises:

comparing the long term air fuel ratio factor to a set of predetermined minimum long term air fuel ratio correction thresholds; and comparing the long term air fuel ratio factor a set of predetermined maximum long term air fuel ratio correction thresholds.

9. The method as recited in claim 7 wherein comparing the air fuel ratio correction data to the second set of predetermined air fuel ratio correction thresholds comprises:

comparing the short term air fuel ratio factor to a set of predetermined minimum short term air fuel ratio correction thresholds; and comparing the short term air fuel ratio factor to a set of predetermined maximum short term air fuel ratio correction thresholds.

10. A system for monitoring fuel delivery to an internal combustion engine and controlling the engine accordingly, the engine having a first and second mode of operation and emitting exhaust gas, the system comprising:

a sensor for sensing an oxygen content of the exhaust gas and generating a corresponding oxygen content signal; and control logic operative to determine air fuel ratio correction data based on the oxygen content signal, compare the air fuel ratio correction data to a first set of predetermined air fuel ratio correction thresholds to obtain a first signal if the engine is operating in the first mode, compare the air fuel ratio correction data to a second set of predetermined air fuel ratio correction thresholds if the engine is operating in the second mode, and control the engine based on the first and second signals.

11. The system as recited in claim 10 wherein the control logic is further operative to generate a first failure signal based on the comparison between the air fuel ratio correction data and the first set of predetermined air fuel ratio correction thresholds in controlling the engine based on the first signal.

12. The system as recited in claim 11 wherein the control logic is further operative to generate a second failure signal based on the comparison between the air fuel ratio correction data and the second set of predetermined air fuel ratio correction thresholds in controlling the engine based on the second signal.

13. The system as recited in claim 12 further comprising a display for displaying the first or second failure signal.

14. The system as recited in claim 10 wherein the control logic is further operative to determine if the engine is operating in the first mode or the second mode.

15. The system as recited in claim 14 wherein the control logic is further operative to determine a number of cylinders activated during operation of the engine in determining if the engine is operating in the first mode or the second mode.

16. The system as recited in claim 10 wherein the control logic is further operative to determine a long term air fuel ratio factor and determining a short term air fuel ratio factor in determining air fuel ratio correction data.

17. The system as recited in claim 16 wherein the control logic, in comparing the air fuel ratio correction data to the first set of predetermined air fuel ratio correction thresholds, is further operative to compare the long term air fuel ratio factor to a set of predetermined minimum long term air fuel ratio correction thresholds, and compare the long term air fuel ratio factor a set of predetermined maximum long term air fuel ratio correction thresholds.

18. The system as recited in claim 16 wherein the control logic, in comparing the air fuel ratio correction data to the second set of predetermined air fuel ratio correction thresholds, is further operative to compare the short term air fuel ratio factor to a set of predetermined minimum short term air fuel ratio correction thresholds, and compare the short term air fuel ratio factor to a set of predetermined maximum short term air fuel ratio correction thresholds.

19. An article of manufacture for use with an engine having a first and second mode of operation and having a sensor positioned in the engine exhaust upstream of a catalytic converter for sensing an oxygen content of the exhaust gas and generating an oxygen content signal, comprising:

a computer storage medium having a computer program encoded therein for causing a computer to control the engine, the computer program for determining air fuel correction data based on the oxygen content signal, comparing the air fuel ratio correction data to a first set of predetermined air fuel ratio correction thresholds to obtain a first signal if the engine is operating the first mode, comparing the air fuel ratio correction data to a second set of predetermined air fuel ratio correction thresholds to obtain a second signal if the engine is operating in the second mode, and controlling the engine based on the first and second signals.

* * * * *